United States Patent [19]

Mendive et al.

[11] Patent Number: 5,000,100

[45] Date of Patent: Mar. 19, 1991

[54] PELLET FUEL COMBUSTION ASSEMBLY

[76] Inventors: Richard J. Mendive, HCR 5, Box 84A, Priest River, Id. 83856; Dennis E. Needs, P.O. Box 0038, Laclede, Id. 83841

[21] Appl. No.: 397,747

[22] Filed: Aug. 23, 1989

[51] Int. Cl.[5] ..... F23G 5/00

[52] U.S. Cl. ..... 110/250; 110/248; 110/101 C; 110/110

[58] Field of Search ..... 110/186, 256, 250, 293, 110/317, 101 C, 110, 118, 297, 314, 267, 248

[56] References Cited

U.S. PATENT DOCUMENTS

| | | | |
|---|---|---|---|
| 2,191,219 | 2/1940 | Peltz | 110/110 |
| 3,357,379 | 12/1967 | Wiley, Jr. | 110/250 |
| 4,306,506 | 12/1981 | Rotter | 110/256 |
| 4,337,711 | 7/1982 | Bolton | 110/102 |
| 4,430,949 | 2/1984 | Ekenberg | 110/110 |
| 4,454,828 | 6/1984 | Zempel | 110/224 |
| 4,471,702 | 9/1984 | McKinlay | 110/256 |
| 4,598,649 | 7/1986 | Eshleman | 110/118 |
| 4,619,209 | 10/1986 | Traeger et al. | 110/110 |
| 4,738,205 | 4/1988 | Beierle et al. | 110/101 CD |
| 4,782,765 | 11/1988 | Miller et al. | 110/186 |
| 4,785,744 | 11/1988 | Fontaine | 110/297 |
| 4,787,321 | 11/1988 | Schnellbacher et al. | 110/118 |

*Primary Examiner*—Edward G. Favors
*Assistant Examiner*—Denise L. Ferensic
*Attorney, Agent, or Firm*—Paul F. Horton

[57] ABSTRACT

A pellet fuel combustion assembly including a fuel container, an auger for transferring pellet fuel to a burnpot, a top-opening burnpot for receiving the fuel, and an igniter. The burnpot is preferably constructed of insulative ceramic and includes a base portion defining an ignition compartment below the floor of the burnpot. An opening in the floor of the burnpot leads down a ramp to conduct fuel pellets to a position spaced from but closely adjacent the igniter. An air intake port leading into the ignition compartment causes air flow by the hot igniter causing the fuel to ignite by heat conductance as well as radiation. The igniter, once ignition has taken place, is cooled by the air flow and is separated from the extreme temperatures of the combustion chamber by the insulative floor, thus giving a long service life. The combustion assembly may include an air blower for superior combustion and one or more thermocouples positioned over the combustion chamber for controlling activation of the igniter, auger, and blower. The auger features a novel spring type auger member having a diameter substantially less than the feed tube in which it rotates to pull fuel pellets from the container.

20 Claims, 2 Drawing Sheets

PELLET FUEL COMBUSTION ASSEMBLY

BACKGROUND OF THE INVENTION

1. Field of the Invention

This invention relates to combustion assemblies for pellet fuel.

2. Description of the Prior Art

Pellet fuel combustion assemblies are increasing in usage because of their superior efficiency and clean burning characteristics. Common problems with existing units involve the fuel feed systems; igniter maintenance and duration; and operation coordination.

In bottom fed burnpots, as typified by Traeger et al, U.S. Pat. No. 4,619,209, "dead" spots or "cold" spots develop because the underlying fuel is not brought properly to kindling temperature, primarily because of overlying ash. It is therefore desirable that the unit have a top feed mechanism.

In present fuel feed systems utilizing augers, maintenance problems exist primarily because of fine fuel particles becoming embedded between the auger and the fuel feed tube, preventing rotation of the auger. This problem is especially prevalent in pellet or fine fuel systems. Typical auger systems include those of Traeger et al, supra, U.S. Pat. No. 4,738,205, issued to F. Beierle et al; A. Elsenberg, U.S. Pat. No. 4,430,949, G. Peltz, U.S. Pat. No. 2,191,219, and C. Bolton, U.S. Pat. No. 4,337,711.

SUMMARY OF THE INVENTION

The present invention comprises, generally, a pellet fuel combustion assembly having a top fed burnpot; a spring type auger of substantially less diameter than the auger tube for pulling pellet fuel from a pellet container to a ramp feeding into the burnpot; a burnpot constructed of insulative ceramic and defining an ignition chamber located below the floor of the burnpot for preserving the operational life of the igniter located therein; a burnpot with opening and ramp for conducting fuel pellets adjacent, but not in contact with the igniter; and a thermocouple located over the burnpot for sensing temperatures for controlling a burnpot blower, the auger, and the igniter. A more complete description of the invention may be found in the appended claims.

It is therefore a primary object of the present invention to provide a pellet fuel combustion assembly having an electrical resistance type igniter which is insulatively separated from the combustion chamber of a burnpot.

More particularly, it is an object of the present invention to provide a pellet fuel combustion assembly having a burnpot defining an ignition chamber for housing an igniter and defining a ramp for conduction pellet fuel from the combustion chamber to the ignition chamber for non-contact ignition.

Another object of the present invention is to provide a pellet fuel combustion assembly having a spring auger feed mechanism for pulling pellet fuel from a container to a delivery ramp for a top fed burnpot.

Still another object of the present invention is to provide a pellet fuel combustion assembly having one or more thermocouples overlying the burnpot for controlling operation of an igniter, burnpot blower, and an auger.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
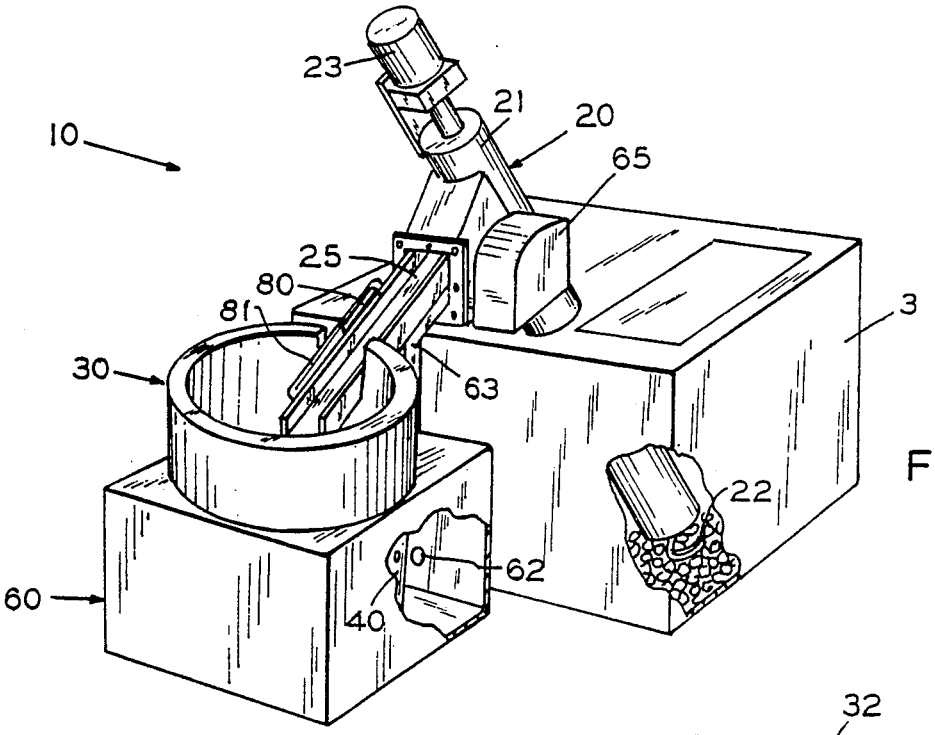
FIG. 1 is a perspective view of one embodiment of the pellet fuel combustion assembly of the present invention.
Figure 6:
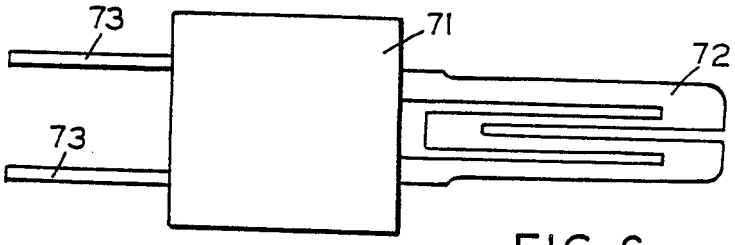
FIG. 6 is a plan view of the igniter of the present invention.
Figure 4:
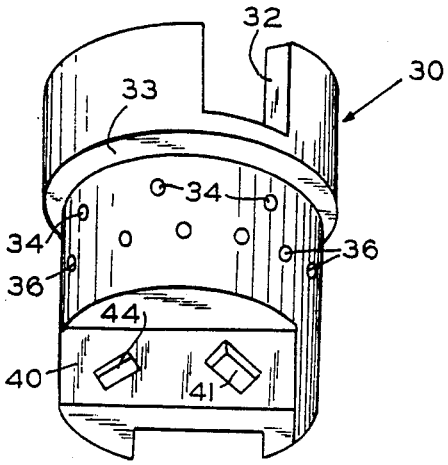
FIG. 4 is a second perspective view of another side of the burnpot.
Figure 3:
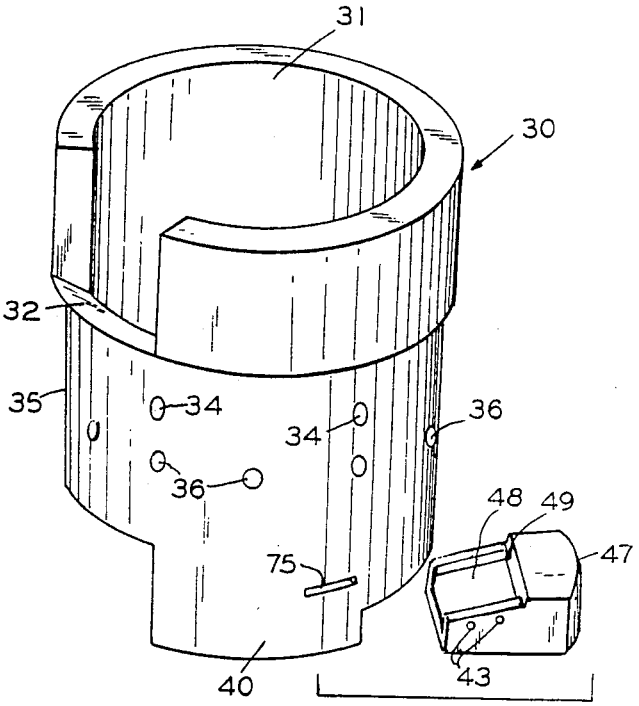
FIG. 3 is a perspective view of one side of the burnpot of FIG. 1, showing the pellet ramp in a removed position.

Referring now to the drawings, and, more particularly to FIG. 1, an embodiment to be preferred of a pellet fuel combustion assembly 10, made according to the present invention is disclosed. Assembly 10 includes, generally, a pellet fuel container or hopper 3; feed means, designated generally by the numeral 20; a burnpot 30; a burnpot support member 60; and ignition means 70, shown to advantage in FIGS. 5 and 6.

Container 3 may be of any suitable size and construction and, in the embodiment shown, is located so that feed means 20 pulls fuel pellets located with the container upwardly where the pellets are dumped onto a downwardly inclined feed ramp 25 for dispensing the pellets into the top opening combustion chamber of burnpot 30.

Figure 7:
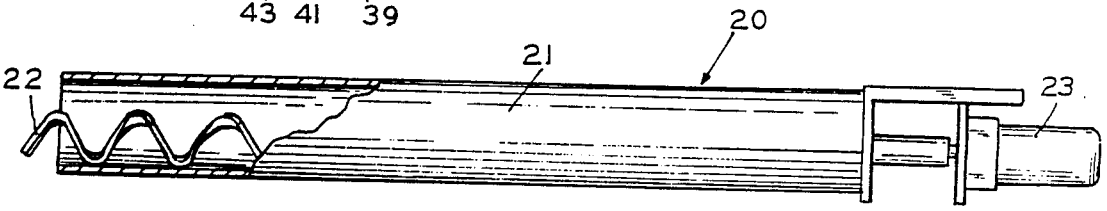
FIG. 7 is a side view in partial section of the auger of the present invention.

Feed means 20 is preferably constructed of a feed tube 21, shown in FIG. 7, working in combination with the feed ramp. Pellet fuel is pulled up the feed tube through operation of an auger 22, which extends longitudinally within the feed tube. Auger 22, unlike conventional fuel feed augers, is a spring auger having an outside diameter approximately one-half the inside diameter of the feed tube and rotatably resting on the interior bottom surface of the feed tube, powered by an electric motor 23. The spring construction is simply helical in form, having no central longitudinal core, and is therefore lightweight. In that the diameter of the auger is substantially less than that of the feed tube, binding of fuel material between auger and tube is completely eliminated. Motor 23 is located at the upper end of the tube, as shown in FIG. 1, so that the pellets are pulled onto ramp 25, rather than pushed.

Figure 2:
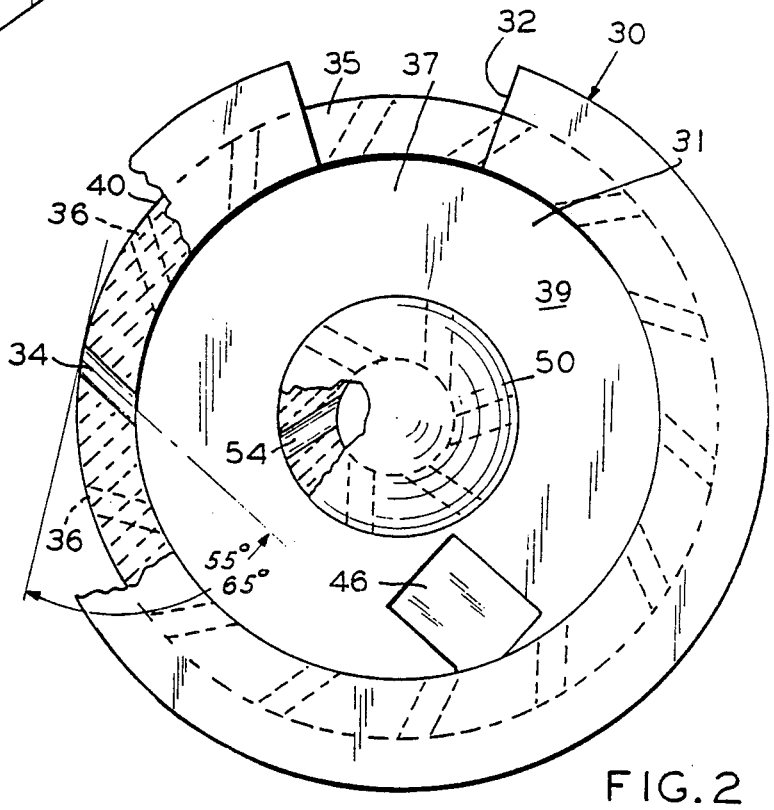
FIG. 2 is a plan view of the burnpot of the present invention.

Burnpot 30, shown in FIGS. 1–5, is preferably constructed of ceramic because of its durability and because of its insulative qualities, as will hereinafter be explained. Referring to FIG. 2, in particular, it will be seen that the burnpot includes a floor member 37 and an upwardly extending tubular sidewall 35 having a top opening 31 and defining combustion chamber 39. The sidewall may include a slot 32 for reception of the lower end of feed ramp 25, and includes an annular shoulder 33 for placement upon and within burnpot support 60. The sidewall, below the shoulder, is provided with a plurality of air inlet ports extending through the sidewall. A first set of air inlet ports 34, located directly beneath shoulder 33 are angularly inclined in the same direction with one another and laterally inclined at an angle of fifty five to sixty five degrees and upwardly at an angle of ten degrees from horizontal to create an upwardly flowing vortex of combustible gases. A second set of air inlet ports 36, spaced about the periphery of the sidewall below and parallel to the first set of ports, laterally inclined in the same direction and at the same angle, but downwardly angled thirteen degrees from horizontal creates a downwardly flowing vortex of gases to keep the combustible gases within the combustion chamber for maximum combustion.

Figure 5:
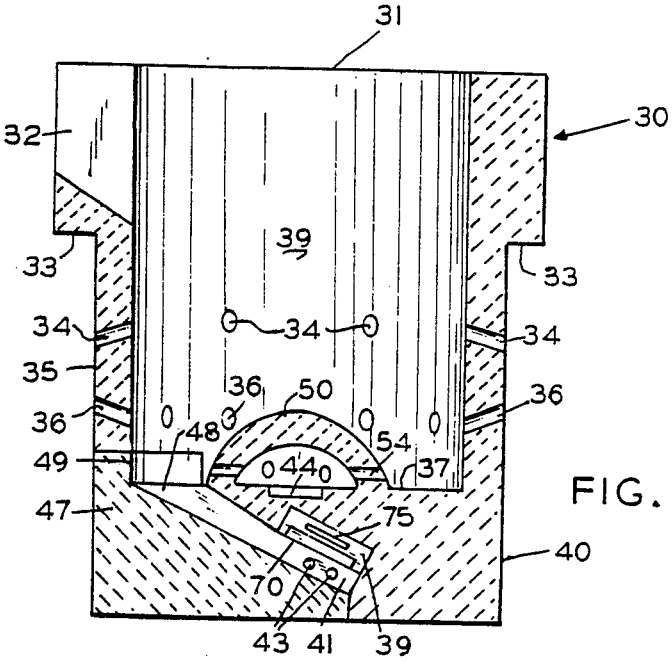
FIG. 5 is a schematic of the burnpot.

Optionally mounted within the combustion chamber at the center of the floor 37 is dome 50, shown to advantage in FIGS. 2 and 5. The dome prevents accumulation of pellets at the center of the floor, forcing the pellets to the sides for more efficient combustion and to prevent "cold" spots similar to bottom fed units. The dome may be provided with a set of air ports 54, laterally angled, which are in fluid communication to the exterior of base 40 by means of air conduit 44, shown in FIG. 4.

Base 40 of the burnpot may be unitary with the sidewall and the floor, except for a removable base ramp member 47, as will hereinafter be explained. The base defines an ignition chamber 41 located below combustion chamber 39 and separated from the combustion chamber by the insulative ceramic floor 37. As shown to advantage in FIG. 5, mounted within and at the uppermost part of ignition chamber 41 is ignition means 70, preferably of the electrical resistance type. A preferred igniter is that manufactured by the Norton Co., model 501, shown in FIG. 6. A tubular housing 71 holds resistive element 72 which extends into the ignition chamber. Housing 71 is placed and packed into base 40 by means of a non-asbestos rope gasket, not shown, and electrical supply wires 73 are connected to a suitable plug-in socket, also not shown.

A tubular opening 46 through floor 36 of the burnpot is in communication with ignition chamber 41 for conductance of fuel pellets into the chamber in close proximity to the igniter 70. It will be seen that the igniter, in being located at the top of the chamber, does not come into contact with the pellet fuel. An air slot 75 extending from the external surface of base 40 and opening into ignition chamber 41 just above the resistive element of the igniter is provided for reasons later explained.

For convenient cleaning of the ignition chamber, the base may be provided with a removable ramp member 47. The ramp member simply slides into a cavity defined in the base where it is held in position. The ramp member includes an inclined slope 48 on its upper surface for conducting the pellets adjacent the igniter and an abutment member 49 defining a portion of the end of the ignition chamber. A pair of air conduits 43 extend through the abutment member of the ramp for conducting air up slope 48 and through floor opening 46 into the combustion chamber.

Referring again to FIG. 1, it will be seen that burnpot 30 is supported by box-like support member 60 with the shoulders 33 of the burnpot resting in sealing engagement with the top plate of the support member and the rest of the burnpot suspended through an opening in the top plate. Support member 60 is air tight and is provided with an air intake port 62. An air blower 65, remotely located from the burnpot, forces air through port 62 and into support member 60, as by means of tube 63.

Thermocouple 80, which senses a first temperature of one hundred fifty degrees and a second temperature of one thousand degrees, is located within a ceramic tube 81, affixed to feed ramp 25. The thermocouple is located over combustion chamber 39 to sense the temperature at the top of the chamber. The thermocouple controls the auger, blower, and igniter.

For operation, container 3 is filled with fuel pellets of wood, pea coal, or corn. Once a thermostat, not shown, is activated to start a fire in the burnpot, a series of timers, also not shown, are activated to provide electrical current to igniter 70; to feed means 20; and to blower 65. Fuel pellets are pulled up through feed tube 21 by auger 22 and transferred to feed ramp 25, where they slide into combustion chamber 39. Fuel pellets falling through floor opening 46 slide down slope 48 of ramp member 47 and into ignition chamber 41 of base 40.

Resistive element 72 of igniter 70, once activated, becomes very hot. Air coming from blower 65, through air intake tube 62 into sealed support member 60 is then caused to flow through all air ports leading into combustion chamber 39. Among these ports is air slot 75. Air blowing through slot 75 flows over resistive element 72, where it is super-heated, and then brought into heat exchange contact with fuel pellets contained within the ignition chamber. It will be seen, then, that the fuel pellets are ignited both by radiation and by heat conduction. The hot air and combustible fumes flow upward through floor opening 46, causing other fuel pellets located within the combustion chamber to ignite. Pressurized air within sealed support member 60, from blower 65, causes a vortex of air within the combustion chamber as air rushes through air ports 34 and 36 of the burnpot sidewall and through air conduit 44 of the base and thence through laterally inclined air ports 54 of dome 50. It will be noted and is a novel part of this invention that air rushing through conduits 43 and up slope 48 of ramp member 47 blow any ashes and combustible residue up the slope and into the combustion chamber, serving to keep the ramp and ignition chamber clean, and also aid in cooling the ignition chamber and hence igniter 70.

Once a thermostat is activated and thermocouple 80 senses a temperature of under one thousand degrees, the igniter will be activated for a period of two minutes. If a temperature of at least one hundred fifty degrees is not sensed, the igniter will remain on for an additional two minutes or until one hundred fifty degrees Fahrenheit is obtained. Once obtained, the igniter is shut down and air blowing through air slot 75 continues to keep the igniter cool, thus substantially increasing its effective life and reducing servicing problems. Once the thermocouple senses a temperature exceeding one thousand degrees Fahrenheit, the timers are overcome and the blower and auger continue their operation. Should the temperature then fall below one thousand degrees, because of difficulties such as blower deactivation, interrupted fuel supply, excessive debris in the combustion chamber, or the like, the auger shuts off immediately; the blower continues operation for a predetermined interval of time and the unit is then completely shut down.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

We claim:

1. A pellet fuel combustion assembly comprising:
a pellet fuel container;
feed means for receiving pellet fuel from said container and transferring the fuel to a burnpot;
a burnpot including a floor member surrounded by a vertical sidewall defining a top opening combustion chamber for receiving fuel pellets, said sidewall provided with a plurality of air conducting apertures for fuel combustion; and a base member, said base member defining an ignition chamber below said floor member, and said floor member provided with an opening for conducting fuel pellets into said ignition chamber; and
ignition means located within said ignition chamber for igniting the pellets.

2. The assembly as described in claim 1 wherein said floor member is constructed of insulative material.

3. The assembly as described in claim 2 wherein said floor member is constructed of ceramic.

4. The assembly as described in claim 1 wherein said ignition means is located adjacent the uppermost portion of said ignition chamber to prevent contact with the pellet fuel.

5. The assembly as described in claim 1 further comprising a ramp member located within said base member for conducting pellet fuel from said opening of said floor member to a position in proximity with said ignition means.

6. The assembly as described in claim 5 wherein said ramp member is removable from said base member for cleaning.

7. The assembly as described in claim 1 wherein said ignition chamber is provided with one or more air inlet ports.

8. The assembly as described in claim 1 wherein said ignition means includes an electrical resistive element.

9. The assembly as described in claim 1 wherein said feed means includes a feed tube; a spring auger, having a diameter substantially less than the inside diameter of said feed tube, rotatably mounted within said feed tube; and drive means for rotating said auger to pull fuel from said container.

10. The assembly as described in claim 1 further comprising one or more thermocouples mounted over and adjacent the top opening of said burnpot, said thermocouples operable to control actuation of said ignition means and said feed means.

11. The assembly as described in claim 1 further comprising a sealed support member surrounding and supporting said burnpot and an air blower in fluid communication with said support member for forcing air though said air conducting apertures of said burnpot.

12. A pellet fuel combustion assembly comprising:
a pellet fuel container;
feed means for receiving pellet fuel from said container and transferring the fuel to a burnpot;
a burnpot including a floor member having a bottom opening; a vertical sidewall surrounding said floor to define a top opening combustion chamber for receiving fuel pellets and said sidewall provided with a plurality of air conducting apertures for fuel combustion; and a base member located beneath said floor member, said base member defining an ignition chamber provided with an air conduit, and said base member provided with a removable ramp for conducting fuel pellets to said ignition chamber;
ignition means located within said ignition chamber for igniting the pellets;
a sealed support member surrounding said burnpot; and
a burnpot air blower for forcing air into said sealed support member and hence through the air conducting apertures of said burnpot.

13. The pellet fuel combustion assembly as described in claim 12 wherein said burnpot is constructed of ceramic.

14. The pellet fuel combustion assembly as described in claim 12 further comprising one or more thermocouples mounted over and adjacent the combustion chamber of said burnpot, said thermocouples operable to control said ignition means and said feed means.

15. The pellet fuel combustion assembly as described in claim 12 wherein said burnpot further includes a dome, upstanding in the substantial center of said burnpot floor member for forcing fuel pellets to the side of said floor member.

16. The pellet fuel combustion assembly as described in claim 12 wherein said sidewall apertures are laterally inclined to create a vortex within the combustion chamber of said burnpot.

17. The pellet fuel combustion assembly as described in claim 12 wherein said feed means includes a feed tube; an auger supported by and resting on the bottom interior surface of said feed tube; and a motor for rotating said auger to pull fuel pellets from said container for dispensing into the combustion chamber of said burnpot.

18. A pellet fuel combustion assembly comprising:
a pellet fuel container;
feed means for receiving pellet fuel from said container and transferring the fuel to a burnpot;
a ceramic burnpot including a floor member having a bottom opening; a vertical sidewall surrounding said floor to define a top opening combustion chamber for receiving fuel pellets, said sidewall provided with a plurality of air conducting apertures for fuel combustion; and a base member located beneath said floor member, said base member defining an ignition chamber provided with an air conduit, and said base member provided with a removable ramp for conducting fuel pellets to said ignition chamber;
an electrical resistance type igniter located within said ignition chamber for igniting the pellets;
a sealed support member surrounding said burnpot;
a burnpot air blower for forcing air into said sealed support member and hence through the air conducting apertures of said burnpot; and
one or more thermocouples mounted over and adjacent the combustion chamber, each of said thermocouples operable to control actuation of said feed means, said igniter, and said blower.

19. The pellet fuel combustion assembly as described in claim 18 wherein said feed means includes a feed tube; an auger supported by and resting on the bottom interior surface of said feed tube; and a motor for rotating said auger to pull fuel pellets from said container for dispensing into the combustion chamber of said burnpot.

20. The pellet fuel combustion assembly as described in claim 18 wherein said removable ramp is provided with one or more air conduits for blowing debris located within said ignition chamber into said combustion chamber.

* * * * *